US006755279B2

(12) United States Patent
Kaneko et al.

(10) Patent No.: US 6,755,279 B2
(45) Date of Patent: Jun. 29, 2004

(54) CONTROLLABLE MUFFLER SYSTEM FOR INTERNAL COMBUSTION ENGINE

(75) Inventors: Yukio Kaneko, Saitama (JP); Tanomo Norikawa, Kanagawa (JP); Shinichi Horiuchi, Kanagawa (JP); Kai Takeuchi, Kanagawa (JP); Atsushi Kijima, Kanagawa (JP)

(73) Assignees: Calsonic Kansei Corporation, Tokyo (JP); Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/949,606

(22) Filed: Sep. 12, 2001

(65) Prior Publication Data

US 2002/0033302 A1 Mar. 21, 2002

(30) Foreign Application Priority Data

Sep. 11, 2000 (JP) ..... 2000-275072
Dec. 28, 2000 (JP) ..... 2000-401412

(51) Int. Cl.[7] ..... F01N 7/02

(52) U.S. Cl. ..... 181/232; 181/212; 181/227; 181/237; 181/250; 181/251; 181/254

(58) Field of Search ..... 181/232, 254, 181/272, 251, 275, 212, 227, 237, 250, 268, 277–279

(56) References Cited

U.S. PATENT DOCUMENTS 3,317,001 A * 5/1967 Powers et al. ..... 181/232
5,014,817 A * 5/1991 Takato et al. ..... 181/254
5,355,973 A * 10/1994 Wagner et al. ..... 181/258
6,167,699 B1 * 1/2001 Johnston et al. ..... 60/304

FOREIGN PATENT DOCUMENTS

| | | |
|---|---|---|
| JP | 4-72408 | 3/1992 |
| JP | 4-54917 | 5/1992 |
| JP | 454917 | * 5/1992 |
| JP | 7-91246 | 4/1995 |
| JP | 9-79051 | 3/1997 |
| JP | 9-228819 | 9/1997 |
| JP | 10-131738 | 5/1998 |

* cited by examiner

*Primary Examiner*—Kimberly Lockett
*Assistant Examiner*—Renata McCloud
(74) *Attorney, Agent, or Firm*—Foley & Lardner LLP

(57) ABSTRACT

A controllable muffler system is sued for use with an engine that produces a power by burning fuel. The system comprises a first passage section extending from the engine for having an exhaust gas of the engine flow therethrough. The first passage section has a catalytic converter mounted thereon. The system further comprises a dual passage section including second and third passage sections which extend separately from an end of the first passage section. The second passage has a control valve for controlling the flow rate of the exhaust gas flowing therethrough. The system further comprises a fourth passage section extending from respective ends of the second and third passage sections to the open air. The fourth passage section has a rear muffler mounted thereon. The system further comprises a control unit which controls the control valve of the second passage section in accordance with an operation condition of the engine.

21 Claims, 9 Drawing Sheets

CONTROLLABLE MUFFLER SYSTEM FOR INTERNAL COMBUSTION ENGINE

BACKGROUND OF THE INVENTION

1. Field of the Invention

The present invention relates in general to muffler systems of an automotive engines, and more particularly to the muffler systems of a controllable type that can control its sound muffling or dampening performance in accordance with engine speed or the like.

2. Description of Related Art

In order to clarify the task of the present invention, some known controllable muffler systems of the above-mentioned type will be briefly described with reference to the accompanying drawings.

In FIG. 8, there is shown one muffler system that is described in Japanese Patent First Provisional Publication 4-72408. The system of this publication generally comprises a chamber body 100A, an inlet pipe (no numeral) led into the chamber body 100A and two outlet pipes 101 and 102 extending to the outside from the interior of the chamber body 100A. The outlet pipe 101 is equipped with a control valve 103 that is controlled in accordance with an operation condition (e.g. engine speed) of an associated engine.

In FIG. 9, there is shown another known muffler system that is described in Japanese Utility Model First Provisional Publication 4-54917. The system of this publication generally comprises a chamber body 100B and two inlet pipes 104 and 105 of which upstream ends are mated. The inlet pipe 104 passes through the chamber body 100B, having small openings thereof exposed to the interior of the chamber body 100B, while the other inlet pipe 105 is led into a middle position of the chamber body 100B. The inlet pipe 104 is equipped with a control valve 106 that is controlled in accordance with an operation condition (e.g. engine speed) of an associated engine.

Due to provision of the control valves 103 and 106, the above-mentioned known muffler systems can exhibit optimum performance in accordance with the engine operation condition. However, increase in cost can not be avoided because of employment of the control valves 103 and 106 which are actuated by complicated electronic control systems.

In FIG. 10, there is shown still another known muffler system that is described in Japanese Patent First Provisional Publication 10-131738, which can be produced at relatively low cost. The system generally comprises a chamber body 100C, an inlet pipe, an outlet pipe and an inner pipe 107. The inner pipe 107 is equipped at its downstream end with an exhaust pressure sensible valve 108. That is, the valve 108 is controlled to open/close the inner pipe 107 in accordance with a pressure difference created in the chamber body 100C.

SUMMARY OF THE INVENTION

However, even the system of FIG. 10 tends to fail to exhibit at 20 a satisfied performance because of the nature of the exhaust pressure sensible valve 108. In particular, adjustment of the valve 108 for obtaining a desired muffling performance is difficult.

Accordingly, an object of the present invention is to provide a controllable muffler system which is free of the above-mentioned drawbacks.

According to the present invention, there is provided a controllable muffler system which can be arranged entirely below a vehicle floor to obtain an optimum controllable muffling performance thereof.

According to a first aspect of the present invention, there is provided a controllable muffler system for use with an engine that produces a power by burning fuel, which comprises a first passage section extending from the engine for having an exhaust gas of the engine flow therethrough, the first passage section having a catalytic converter mounted thereon; a dual passage section including second and third passage sections which extend separately from an end of the first passage section, the second passage having a control valve for controlling the flow rate of the exhaust gas flowing therethrough; a fourth passage section extending from respective ends of the second and third passage sections to the open air, the fourth passage section having a rear muffler mounted thereon; and a control unit which controls the control valve of the second passage section in accordance with an operation condition of the engine.

According to a second aspect of the present invention, there is provided a controllable muffler system for use with an internal combustion engine, which comprises a first passage section extending from the engine for having an exhaust gas of the engine flow therethrough, the first passage section having a catalytic converter and a front muffler mounted thereon; a dual passage section including second and third passage sections which extend separately from an end of the first passage section, the second passage having a control valve for controlling the flow rate of the exhaust gas flowing therethrough; a fourth passage section extending from respective ends of the second and third passage sections to the open air, the fourth passage section having a rear muffler mounted thereon; and a control unit which controls the control valve of the second passage section in accordance with an operation condition of the engine.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

In the following, the present invention will be described in detail with reference to the accompanying drawings.

For ease of understanding, various directional terms such as right, left, upper, lower, rightward and the like are used in the description. However, such terms are to be understood with respect to only a drawing or drawings on which the corresponding part or portion is shown.

Figure 1:
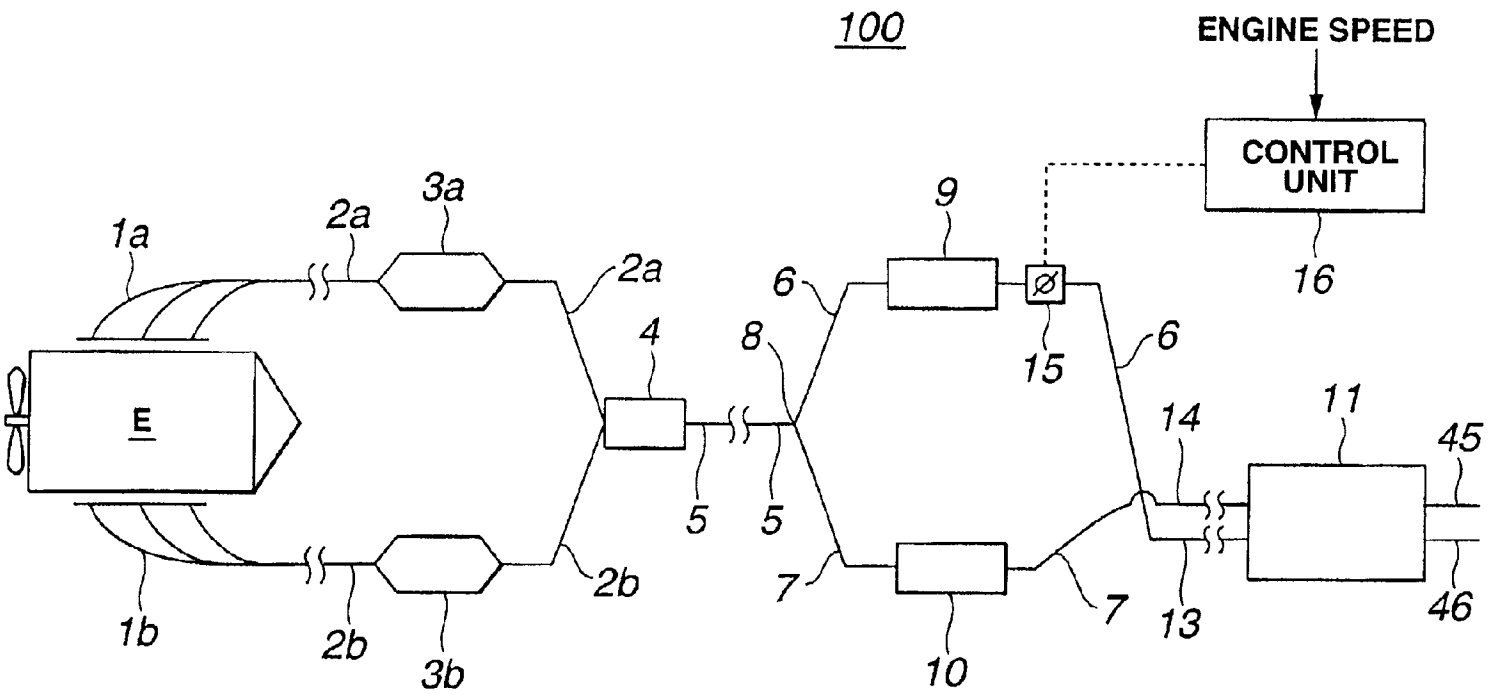
FIG. 1 is a diagram showing a controllable muffler system of a first embodiment of the present invention.
Figure 2:
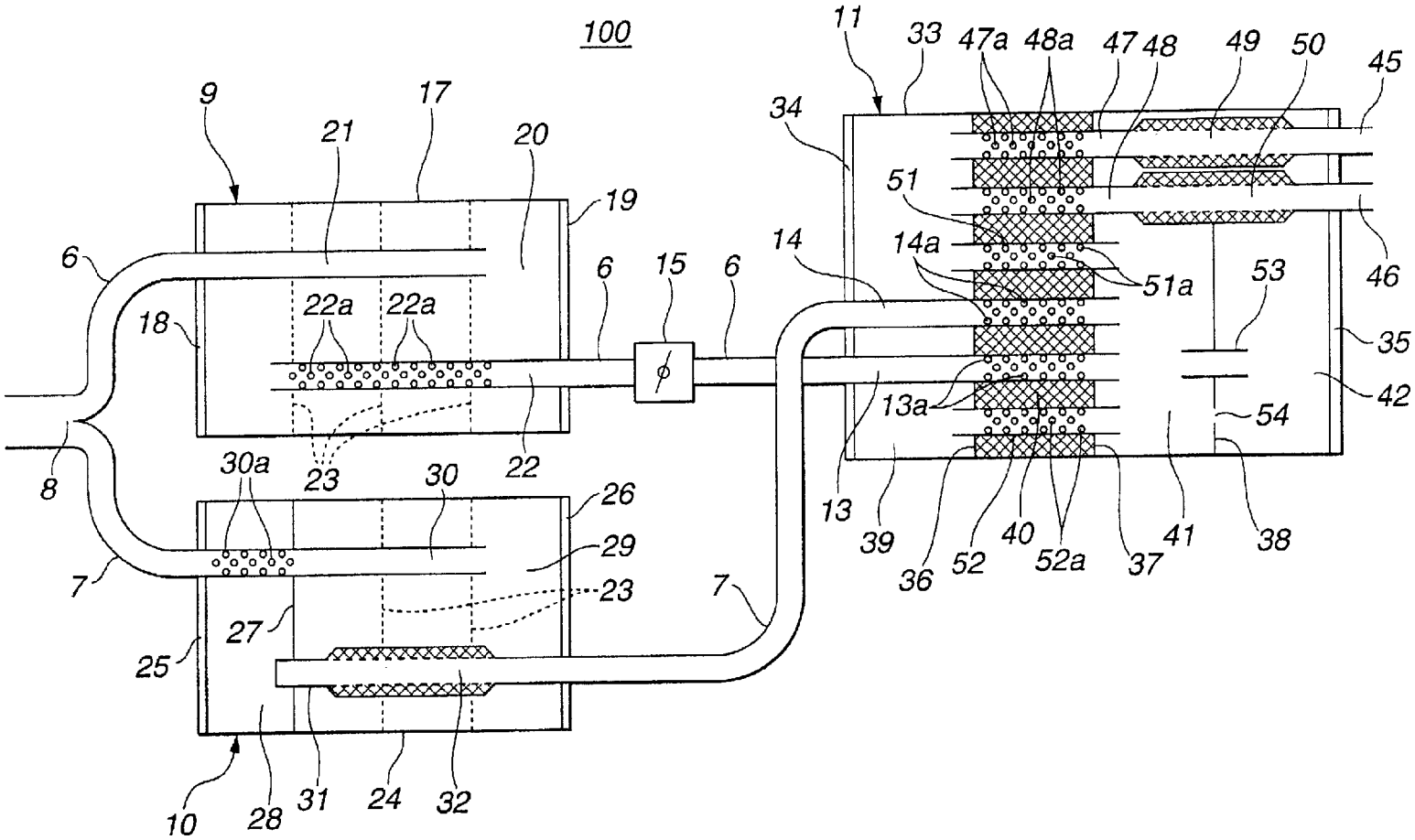
FIG. 2 is an enlarged sectional view of an essential portion of the controllable muffler system of the first embodiment.

Referring to FIGS. 1 and 2, particularly FIG. 1, there is shown a controllable muffler system 100 which is a first embodiment of the present invention.

In the drawing, denoted by reference "E" is a V-type internal combustion engine having two cylinder banks. As shown, from the two cylinder banks of the engine"E", there extend respective exhaust systems each generally comprising an exhaust manifold 1*a* or 1*b* which directly extends from the cylinder bank, a front tube 2*a* or 2*b* which extends from the exhaust manifold 1*a* or 1*b* and a catalytic converter 3*a* or 3*b* which is disposed on the front tube 2*a* or 2*b*. This system is called"dual exhaust system" and brings about a high engine performance because of a satisfied lowering of exhaust interference.

As shown, downstream ends of the front tubes 2*a* and 2*b* are united and led to an inlet of a front muffler 4. From an outlet of the front muffler 4, there extends a rear tube 5. The rear tube 5 has a branched rear end 8 from which two tubes 6 and 7 extend separately. The tubes 6 and 7 have first and second center mufflers 9 and 10 mounted thereon respectively. Rear ends of the tubes 6 and 7 are led to a rear muffler 11. As will be described in detail hereinafter, the rear ends of the tubes 6 and 7 are respectively connected to respective inlet pipes 13 and 14 of the rear muffler 11 and the rear muffler 11 has two tail pipes 45 and 46.

On the tube 6 downstream of the first center muffler 9, there is mounted a butterfly valve 15 which is controlled by a control unit 16. That is, the control unit 16 controls the butterfly valve 15 in accordance with an engine speed. For this controlling, the measures disclosed by Japanese Patent First Provisional Publication 9-79051 or 7-91246 may be used. That is, in the measure of the 9-79051 publication, an electric actuator driven by a control signal is used for actuating the valve, while in the measure of the 7-91246, a vacuum type actuator is used for actuating the valve. That is, in the latter measure, by selectively introducing a vacuum into the actuator from a vacuum tank which is communicated with an intake manifold of the engine, the actuator drives the valve.

Referring to FIG. 2, there is shown the detail of the first and second center mufflers 9 and 10, the rear muffler 11 and the connection therebetween.

As shown, the first center muffler 9 incorporated with the butterfly valve 15 comprises a cylindrical shell 17. Front and rear open ends of the shell 17 are closed by front and rear plates 18 and 19. Three apertured panels 23 are arranged in the shell 17 to form a noise damping expansion chamber 20 in the shell 17. As shown, an inlet pipe 21 extending from an upstream part of the tube 6 is inserted into the shell 17 from the front plate 18 and led to the rightmost area exposed to the rear plate 19. While, an outlet pipe 22 connected to a downstream part of the tube 6 is inserted into the shell 17 from the rear plate 19 and led to the leftmost area exposed to the front plate 18. The outlet pipe 22 is formed with a plurality of small openings 22*a* exposed to a center area of the noise damping expansion chamber 20. The inlet and outlet pipes 21 and 22 are held by the apertured panels 23.

The second center muffler 10 comprises a cylindrical shell 24 of which front and rear open ends are closed by front and rear plates 25 and 26. A partition wall 27 is arranged in the shell 24 to define therein smaller and larger chambers which are an expansion chamber 28 and a resonance chamber 29 respectively. Within the larger resonance chamber 29, there are arranged two apertured panels 23. As shown, an inlet pipe 30 extending from an upstream part of the tube 7 is inserted into the shell 24 from the front plate 25 and led to the resonance chamber 29. The inlet pipe 30 is formed with a plurality of small openings 30*a* exposed to the expansion chamber 28. While, an outlet pipe 31 extending from a downstream part of the tube 7 is inserted into the shell 24 from the rear plate 26 and led to the expansion chamber 28. The outlet pipe 31 is formed with a plurality of small openings at a portion exposed to the resonance chamber 29, and the portion where the small openings are formed is wrapped with a sound absorbing material to constitute a sound absorbing chamber 32.

The rear muffler 11 comprises a cylindrical shell 33 of which front and rear open ends are closed by respective plates 34 and 35. Three partition panels 36, 37 and 38 are arranged in the shell 33 to define four chambers 39, 40, 41 and 42, which are a first expansion chamber 39, a sound absorbing chamber 40, a second expansion chamber 41 and a resonance chamber 42. The sound absorbing chamber 40 has a sound absorbing material packed therein. The two inlet pipes 13 and 14 extending from the tubes 6 and 7 are inserted into the shell 33 from the front plate 34 and led to the second expansion chamber 41. The inlet pipes 13 and 14 are formed with a plurality of small openings 13*a* and 14*a* which are exposed to the sound absorbing chamber 40, as shown.

Two outlet pipes 47 and 48 extending from the two tail pipes 45 and 46 are inserted into the shell 33 from the rear plate 35 and led to the first expansion chamber 39. The outlet pipes 47 and 48 are formed with a plurality of small openings 47*a* and 48*a* which are exposed to the sound absorbing chamber 40. Each of the outlet pipes 47 and 48 is formed, at a part thereof extending between the second expansion chamber 41 and the resonance chamber 42, with a plurality of small openings, and the portion where these openings are provided is wrapped with a sound absorbing material to constitute a sound absorbing chamber 49 or 50.

Within the rear muffler 11, there are further installed two inner pipes 51 and 52 each extending between the first expansion chamber 39 and the second expansion chamber 41 while passing through the sound absorbing chamber 40. These inner pipes 51 and 52 are formed with a plurality of small openings 51*a* and 52*a* which are exposed to the sound absorbing chamber 40. Furthermore, there is installed another inner pipe 52 which is held by the partition panel 38 and extends between the second expansion chamber 41 and the resonance chamber 42. The partition panel 38 is formed with an opening 54 through which the second expansion chamber 41 and the resonance chamber 42 are connected.

In the rear muffler 11, the following dimensional relation is established between the two inlet pipes 13 and 14 and the second expansion chamber 41:

$$\text{Expansion ratio}=S41/(S13+S14) \quad (1)$$

Wherein: S41: sectional area of second expansion chamber 41,

S13: sectional area of first inlet pipe 13,

S14: sectional area of second inlet pipe 14.

In the following, operation of the above-mentioned controllable muffler system 100 of the first embodiment will be described.

As is described hereinabove, based on the engine speed, the control unit 16 issues a control signal to control operation of the butterfly valve 15.

Under Middle/High Speed Operation

When the engine speed increases to a middle or high level thereby to increase the amount of exhaust gas, the control unit 16 controls the butterfly valve 15 to open the tube 6. With this, as is seen from FIG. 1, the first center muffler 9 becomes communicated with the rear muffler 11 through the tube 6.

Under this condition, the exhaust gas passing through the catalytic converters 3*a* and 3*b* and the front muffler 4 is separated into two streams at the rear end 8 of the rear tube 5, one being directed toward the first center muffler 9 and the other being directed toward the second center muffler 10. Due to the muffling effect of the front muffler 4, first and second center mufflers 9 and 10 and rear muffler 11, noises of the exhaust gas from the engine"E" are sufficiently dampened and the exhaust gas is discharged to the open air from the tall pipes 45 and 46 of the rear muffler 11.

As is described above, when the butterfly valve 15 is opened, the exhaust gas from the front muffler 4 are permitted to flow through two mutually independent exhaust passages each having the first or second center muffler 9 or 10. That is, under this condition, the exhaust flow passage extending from the front muffler 4 increases its sectional area and thus induces reduction in exhaust resistance. Thus, under the middle or high speed operation, the engine"E" can exhibit a satisfied output performance thereof. Furthermore, due to parallel usage of the two center mufflers 9 and 10, the exhaust flow passage can exhibit a satisfied muffling effect against the exhaust gas flowing therethrough.

In the following, the detail of muffling effect of each muffler 9, 10 or 11 will be described with reference to FIG. 2.

In the first center muffler 9, the exhaust gas passing through the inlet pipe 21 is led into the expansion chamber 20 to expand thereby to reduce or dampen the noises thereof.

In the second center muffler 10, the exhaust gas passing through the inlet pipe 30 is led through the small openings 30a into the expansion chamber 28 to reduce or dampen the noises thereof, the exhaust gas passing through the inlet pipe 30 is led into the resonance chamber 29 to reduce or dampen the noises thereof, and at the same time, the exhaust gas from the expansion chamber 28 is permitted to reduce or dampen the noises thereof during passage of the sound absorbing chamber 32.

In the rear muffler 11, the exhaust gases passing through the inlet pipes 13 and 14 are led into the second expansion chamber 41 to reduce or dampen the noises thereof.

Due to provision of the resonance chamber 42, the noises of the exhaust gas led into the second expansion chamber 41 are dampened. The exhaust gas is then led into the first expansion chamber 39 through the two inner pipes 51 and 52 to further reduce or dampen the noises thereof. During this, due to provision of the small openings 51*a* and 52*a* of the pipes 51 and 52, the noises of the exhaust gas are further dampened. The exhaust gas is then led into the outlet pipes 47 and 48 to be discharged to the open air through the tail pipes 45 and 46. During this, due to provision of the small openings 47*a* and 48*a* and the sound absorbing chambers 49 and 50, the noise dampening of the exhaust gas is further developed.

Under Low Speed Operation

When the engine speed reduces to a low level thereby to decrease the amount of exhaust gas, the control unit 16 controls the butterfly valve 15 to close the tube 6. With this, as is seen from FIG. 1, the communication between the first center muffler 9 and the rear muffler 11 is blocked.

Under this condition, the exhaust gas from the front muffler 4 is permitted to flow through only the lower exhaust passage including the tube 7 and the second center muffler 10. As shown in FIG. 2, the exhaust gas from the tube 7 is led into the second expansion chamber 41 through the second inlet pipe 14 and subjected to the above-mentioned noise dampening. In addition to this, the following additional effects are obtained.

Improved Noise Dampening

When the butterfly valve 15 is closed, the downstream part of the tube 6 can act as an additional tubular branch of the rear muffler 11. Thus, under this condition, due to addition of such tubular branch, the rear muffler 11 can exhibit a noise dampening effect against noises having specified frequencies. Furthermore, under this condition, the chamber 20 of the first center muffler 9 can serve as a resonance chamber to dampen the noises of the exhaust gas led toward the second center muffler 10. If the tube 6 is constructed to have a larger sectional area, low frequency components of the noise of the exhaust gas can be effectively dampened, which suppresses generation of undesired moaning effect in the passenger cabin. Furthermore, the noise dampening effect is much enhanced because of the addition of the resonance chamber 20 at a position remote from the rear muffler 11.

When practically used, the controllable muffler system 100 is entirely arranged below a floor panel of an associated motor vehicle. Since the mufflers 9, 10 and 11 are each constructed simple as is described hereinabove, they can be made compact and thus, the layout of them under the floor panel can have a high freedom.

When the butterfly valve 15 is closed, the following advantageous phenomena are further obtained.

That is, under such condition, in the rear muffler 11, the exhaust gas from the engine"E" is forced to flow through only the inlet pipe 14 before reaching the second expansion chamber 41. That is, under this condition, the Expansion ratio between the chamber 41 and an exhaust gas inlet passage (viz., the inlet pipe 14) is twice as much as that between the chamber 41 and an exhaust gas inlet passage (viz., both the inlet pipes 13 and 14), which improves the noise dampening effect of the system 100.

In the first embodiment 100, the following modifications are usable.

In the above description, the control unit 16 is described to control the butterfly valve 15 in accordance with the engine speed. However, if desired, the control of the butterfly valve 15 may be made in accordance with an accelerator angle of the vehicle, or exhaust or intake pressure of the engine. That is, when the accelerator angle, exhaust pressure or intake pressure (viz., absolute value of intake pressure) is large, the butterfly valve 15 is controlled to open, while when such factor is small, the butterfly valve 15 is controlled to close.

Furthermore, if desired, the butterfly valve 15 may be controlled like in the measures disclosed by Japanese Patent First Provisional Publication 9-228819. That is, the open/close operation of the valve 15 is controlled in accordance with an exhaust pressure exerted in an upstream area of an exhaust pipe or a negative pressure exerted in an intake manifold of the engine. Furthermore, if desired, the butterfly valve 15 may be controlled like in the measures disclosed by Japanese Patent First Provisional Publication 10-131738.

That is, for open/close operation, the butterfly valve 15 is directly applied with an exhaust pressure from the engine.

In the following, other embodiments of the present invention will be described, in which substantially same parts as those of the above-mentioned first embodiment 100 are denoted by the same numerals, and detailed explanation of them will be omitted. That is, only parts or portions which are different from those of the first embodiment 100 will be described in detail for ease of description.

Figure 3:
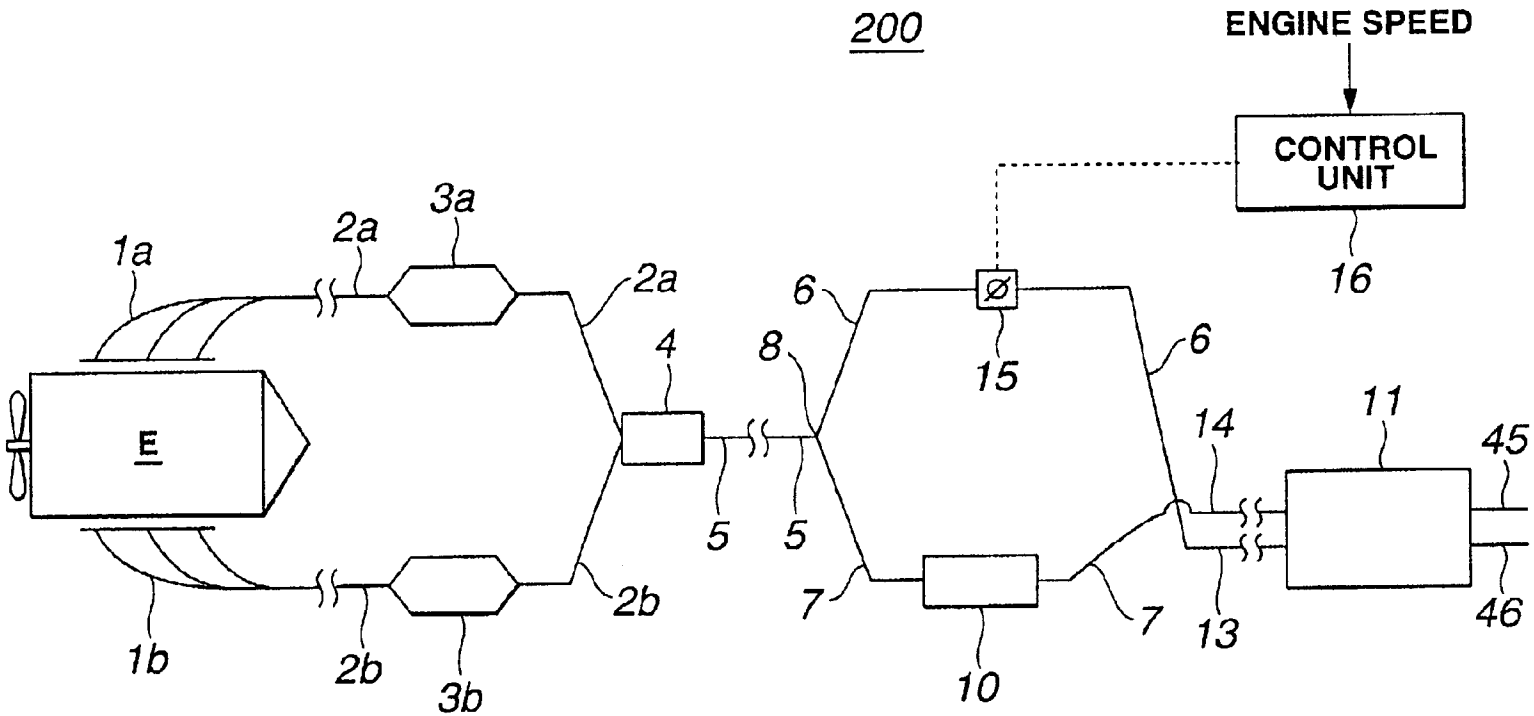
FIG. 3 is a view similar to FIG. 1, but showing a second embodiment of the present invention.

Referring to FIG. 3, there is shown a controllable muffler system 200 which is a second embodiment of the present invention.

That is, in the second embodiment 200, there is no means that corresponds to the first center muffler 9 used in the first embodiment 100.

Thus, when the butterfly valve 15 is closed, the upstream and downstream portions of the tube 6 with respect to the butterfly valve 15 can serves as the above-mentioned side branches thereby to effectively dampen the noises having specified frequencies. While, when the butterfly valve 15 is opened, the tube 6 can serve as a bypass passage for the center muffler 10 thereby to permitting the engine"E" to produce a higher output power.

Due to removal of the first center muffler 9, the freedom in positioning the butterfly valve 15 is improved thereby to much more effectively dampen the low frequency components of noises of the exhaust gas. Furthermore, due to removal of the muffler 9, the entire arrangement of the system 200 can be compact in size and thus mounting of the system 200 under the vehicle floor panel is easily made.

Figure 4:
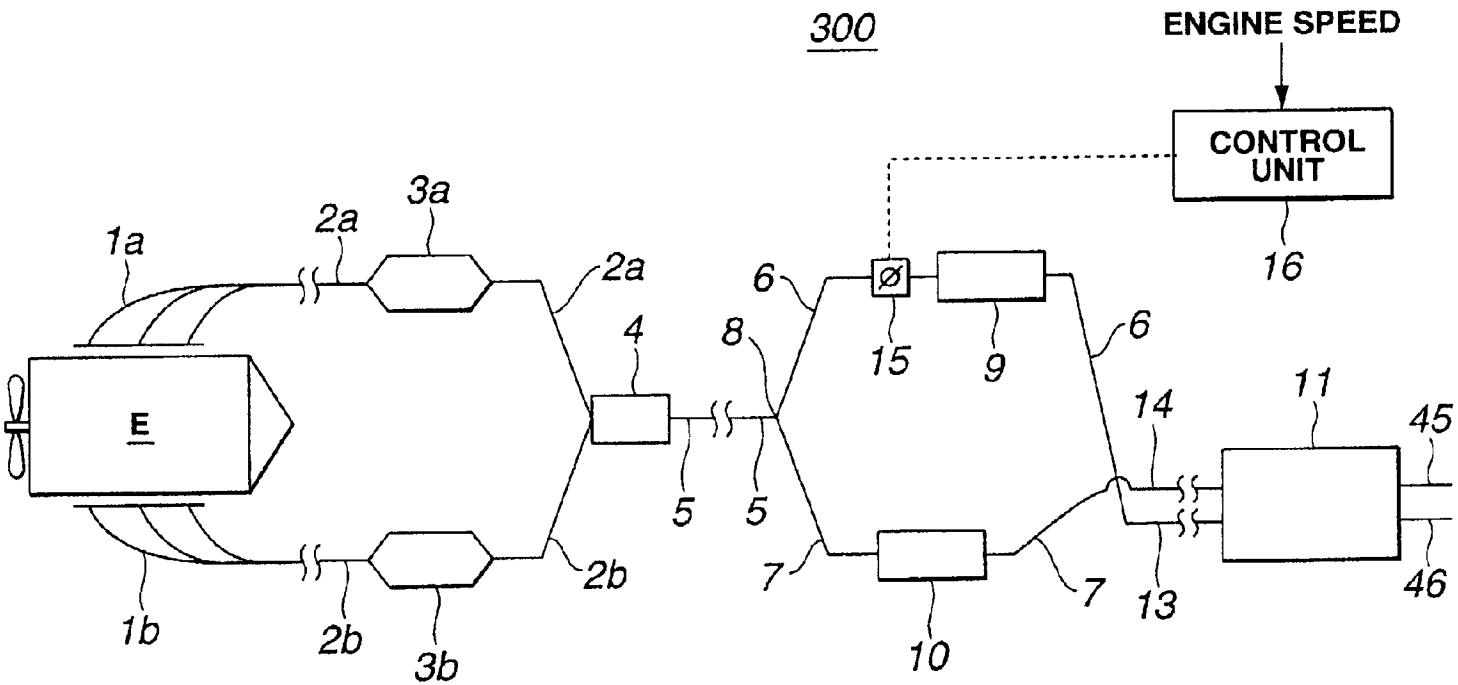
FIG. 4 is a view similar to FIG. 1, but showing a third embodiment of the present invention.

Referring to FIG. 4, there is shown a controllable muffler system 300 which is a third embodiment of the present invention.

In the third embodiment 300, the butterfly valve 15 is mounted on the tube upstream of the first center muffler 9.

That is, similar to the above-mentioned second embodiment 200, when the butterfly valve 15 is closed, the upstream and downstream portions of the tube 6 with respect to the butterfly valve 15 can serve as the above-mentioned side branches thereby to effectively dampen the noises having specified frequencies. In this third embodiment 300, substantially same advantages as those of the first embodiment 100 are obtained. In addition, due to position change of butterfly valve 15 relative to the first center muffler 9, the frequency of the noise effectively damped by the system 300 is changed.

Figure 5:
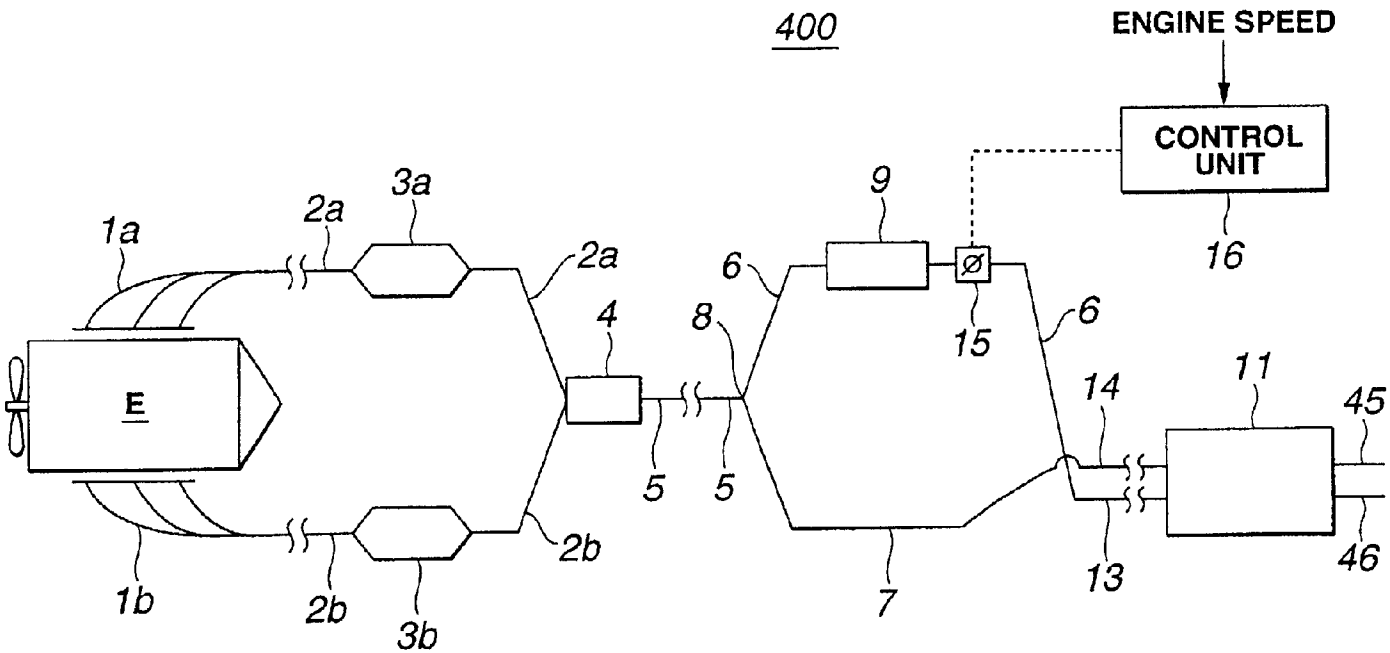
FIG. 5 is a view similar to FIG. 1, but showing a fourth embodiment of the present invention.

Referring to FIG. 5, there is shown a controllable muffler system 400 which is a fourth embodiment of the present invention.

In this fourth embodiment 400, there is no means that corresponds to the second center muffler 10 used in the first embodiment 100.

Thus, when the butterfly valve 15 is closed due to low speed running of the engine"E", the exhaust passage including the tube 7 can exhibit a sufficiently low exhaust pressure due to removal of the center muffler 10 which would cause a certain resistance against the exhaust flow therethrough. Thus, acceleration performance of the engine"E" at the range of low and middle engine speed is improved.

While, when the butterfly valve 15 is opened, the exhaust passage including the tube 7 can serve as a bypass passage of the other passage including the tube 6, the center muffler 9 and the valve 15, which permits the engine"E" to produce a higher output power.

Figure 6:
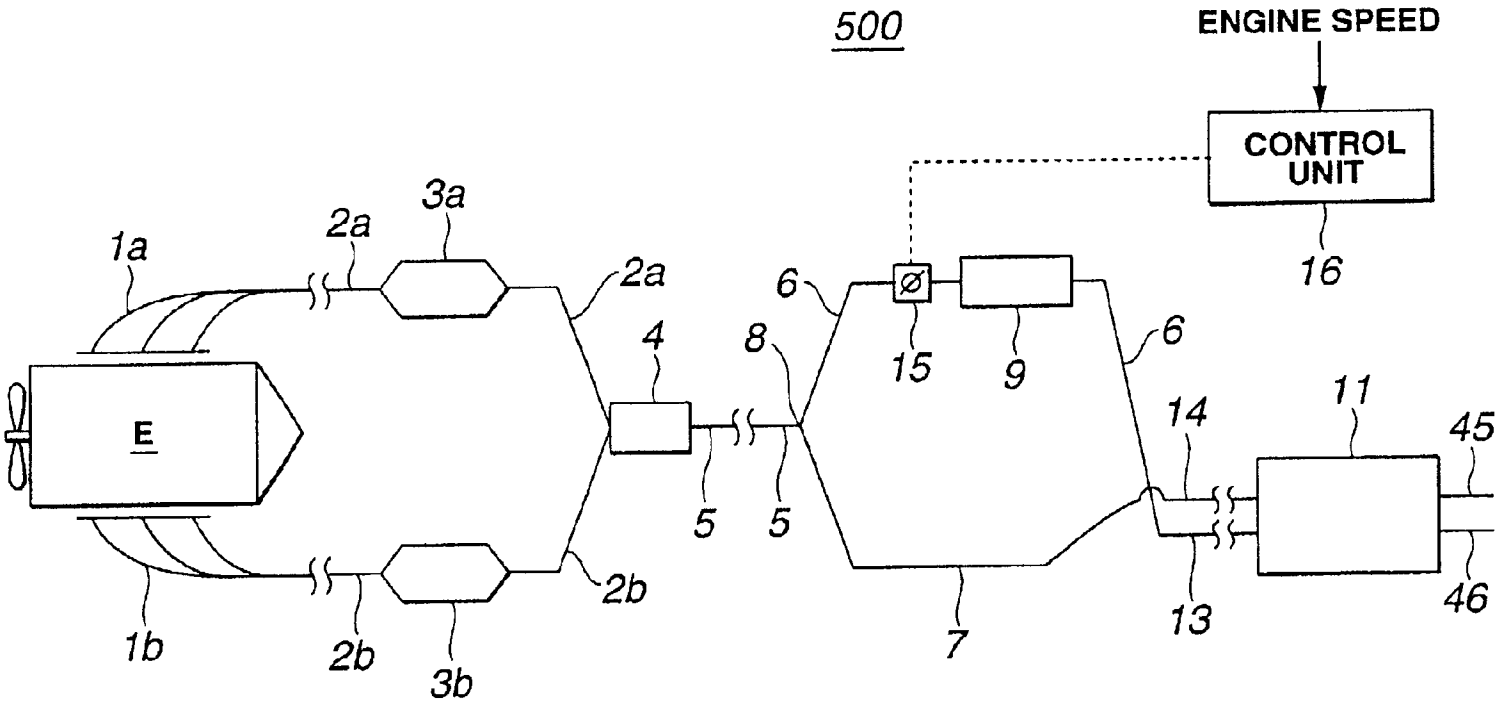
FIG. 6 is a view similar to FIG. 1, but showing a fifth embodiment of the present invention.

Referring to FIG. 6, there is shown a controllable muffler system 500 which is a fifth embodiment of the present invention.

As is seen from the drawing, this fifth embodiment 500 is substantially the same as the fourth embodiment 400 except that, in the fifth embodiment 500, the throttle valve 15 is positioned upstream of the center muffler 9. Thus, substantially same advantages as those of the fourth embodiment 400 are obtained in the fifth embodiment 500.

Figure 7:
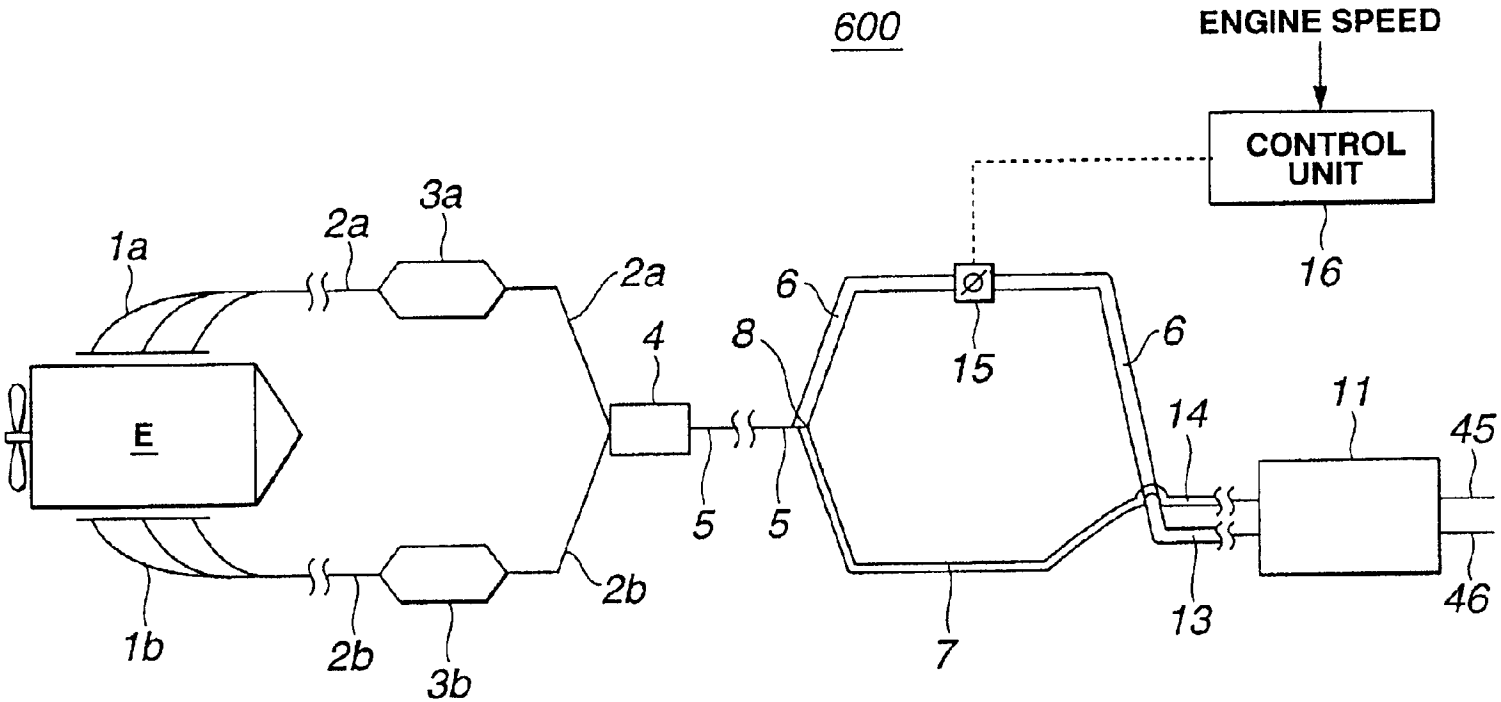
FIG. 7 is a view similar to FIG. 1, but showing a sixth embodiment of the present invention.
Figure 8:
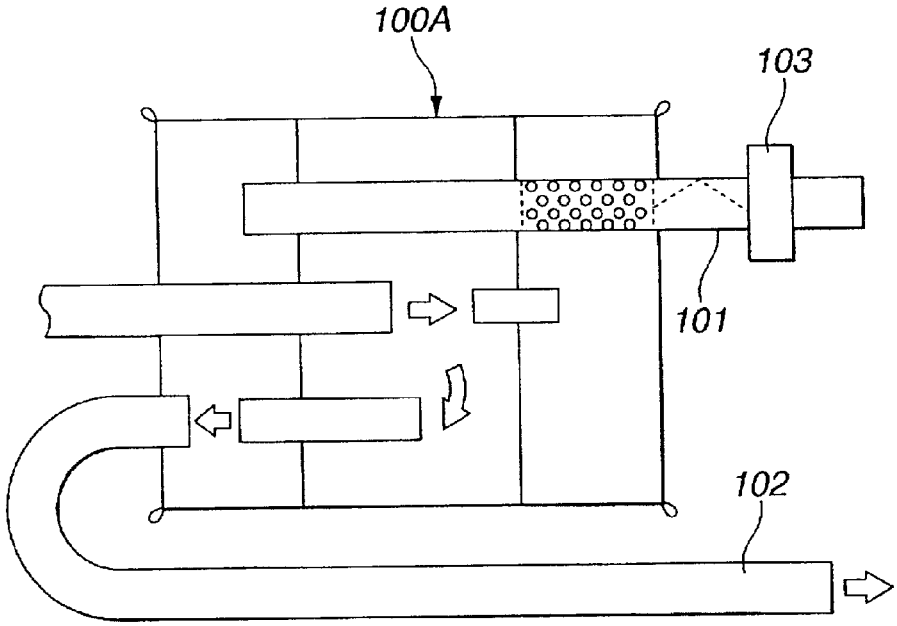
FIG.8 (RELATED ART)
FIG. 8 is a sectional view of a first known controllable muffler system.
Figure 9:
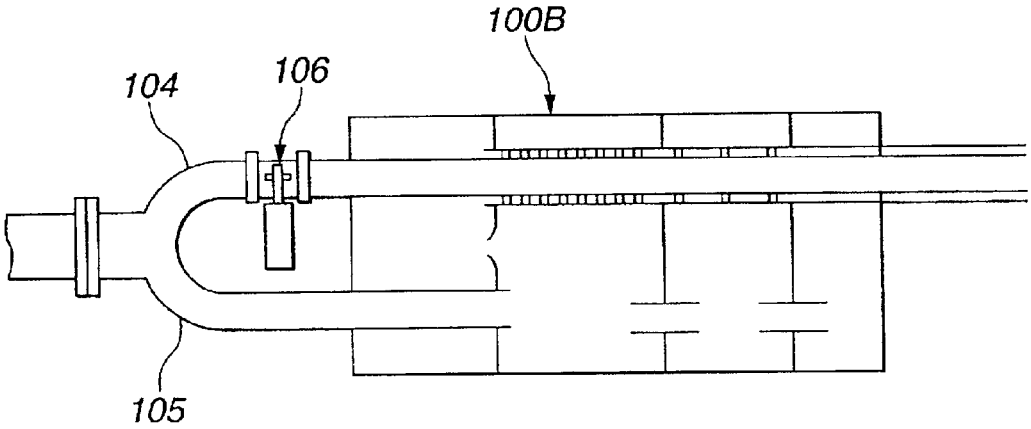
FIG.9 (RELATED ART)
FIG. 9 is a sectional view of a second known controllable muffler system.
Figure 10:
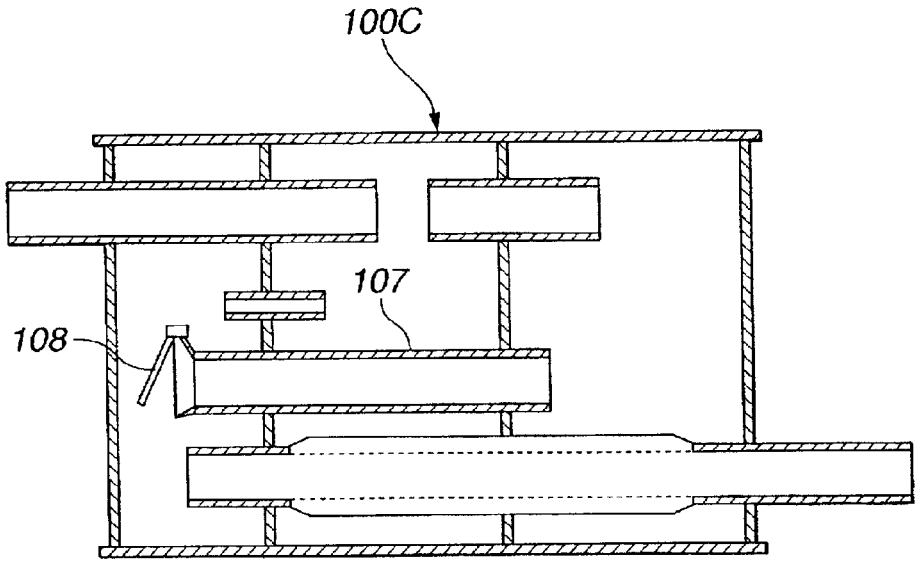
FIG.10 (RELATED ART)
FIG. 10 is a sectional view of a third known controllable muffler system.

Referring to FIG. 7, there is shown a controllable muffler system 600 which is a sixth embodiment of the present invention.

In this sixth embodiment 600, there are no means that correspond to the first and second center mufflers 9 and 10 used in the first embodiment 100. That is, as is seen from the drawing, on the tube 6, there is disposed only the butterfly valve 15, and on the other tube 7, there is no device mounted thereon.

However, as is seen from the drawing, in this sixth embodiment 600, the tube 6 has a sectional area larger than that of the other tube 7.

Thus, when the butterfly valve 15 is closed due to low speed running of the engine"E", the exhaust passage including the tube 7 can exhibit a sufficiently low exhaust pressure due to removal of the center muffler 10 which would cause a certain resistance against the exhaust flow therethrough. Thus, acceleration performance of the engine"E" at the range of low and middle engine speed is improved.

While, when the butterfly valve 15 is opened, the exhaust passage including the tube 7 can serve as a bypass passage of the other passage including the tube 61 and the valve 15, which permits the engine"E" to produce a higher output power.

Furthermore, since the sectional area of the tube 7 is smaller than that of the other tube 6, the tube 7 can have a much effective noise dampening effect. That is, in system 600 of the sixth embodiment, the difference between the pressure exerted when the butterfly valve 15 is opened and the pressure exerted when the valve 15 is closed can be set relatively high.

In the foregoing description, the muffler system of the invention has been described with respect to a V-type internal combustion engine"E" having two cylinder banks. However, the present invention is also applicable to an in-line type internal combustion engine. That is, in this case, one of the two exhaust lines from the engine"E" to the front muffler 4 is removed.

Furthermore, if desired, the front muffler 4 may be removed.

Furthermore, if desired, the tubes 6 and 7 may be united at their downstream portions. In this case, the rear muffler 11 (see FIG. 2) needs only one inlet pipe led thereinto.

The entire contents of Japanese Patent Applications 2000-275072 (filed Sep. 11, 2000) and 2000-401412 (filed Dec. 28, 2000) are incorporated herein by reference.

Although the invention has been described above with reference to the embodiments of the invention, the invention is not limited to such embodiments as described above. Various modifications and variations of such embodiments may be carried out by those skilled in the art, in light of the above descriptions.

What is claimed is:

1. A controllable muffler system for use with an engine that produces a power by burning fuel, comprising:

a first passage section extending from said engine for having an exhaust gas of the engine flow therethrough, said first passage section having a catalytic converter mounted thereon;

a dual passage section including second and third passage sections which extend separately from an end of said first passage section, said second passage having a control valve for controlling the flow rate of the exhaust gas flowing therethrough;

a fourth passage section extending from respective ends of said second and third passage sections to the open air, said fourth passage section having a rear muffler mounted thereon; and a control unit which controls said control valve of the second passage section in accordance with an operation condition of the engine, wherein the dual passage section is arranged downstream of the first passage in a direction of flow of the exhaust gas.

2. A controllable muffler system as claimed in claim 1, in which at least one of said second and third passage sections has a center muffler mounted thereon.

3. A controllable muffler system as claimed in claim 2, in which said center muffler is mounted on said second passage section, and in which said control valve is positioned upstream of said center muffler.

4. A controllable muffler system as claimed in claim 2, in which said center muffler is mounted on said second passage section, and in which said control valve is positioned downstream of said center muffler.

5. A controllable muffler system as claimed in claim 2, in which said center muffler is mounted on said third passage section.

6. A controllable muffler system as claimed in claim 1, in which said second passage section is constructed to have a gas flow resistance which is smaller than that of said third passage section.

7. A controllable muffler system as claimed in claim 1, in which said control unit controls said control valve in accordance with an operation speed of said engine.

8. A controllable muffler system as claimed in claim 7, in which said control unit closes said control valve when the engine is under a low speed operation and opens said control valve when the engine is under a middle/high speed operation.

9. A controllable muffler system as claimed in claim 2, in which said second and third passage sections have respective center mufflers mounted thereon, and in which said control valve is positioned downstream of the center muffler of said second passage section.

10. A controllable muffler system as claimed in claim 9, in which the center muffler mounted on said second passage section comprises:

a cylindrical shell having front and rear ends closed;

apertured panels arranged in said shell;

an inlet pipe extending from the end of said first passage section, said inlet pipe being inserted into the cylindrical shell from said front end and led to a rear portion of the interior of said cylindrical shell to constitute an expansion chamber therein; and an outlet pipe which extends in the cylindrical shell from a front portion of the interior of said cylindrical shell and is led to an upstream end of said fourth passage section, said outlet pipe having an exposed portion on which said control valve is mounted.

11. A controllable muffler system as claimed in claim 10, in which said outlet pipe has a plurality of small openings at a given portion exposed to a generally middle part of the interior of said cylindrical shell.

12. A controllable muffler system as claimed in claim 11, in which the center muffler mounted on said third passage section comprises:

a cylindrical shell having front and rear ends closed;

a partition panel installed in said cylindrical shell to define therein an expansion chamber and a resonance chamber;

apertured panels arranged in said resonance chamber;

an inlet pipe extending from the end of said first passage section, said inlet pipe being inserted into the cylindrical shell from said front end and led to a rear portion of the interior of the cylindrical shell; and an outlet pipe which extends in the cylindrical shell from a front portion of said interior of the cylindrical shell and is led to the upstream end of said fourth passage section.

13. A controllable muffler system as claimed in claim 12, in which said inlet pipe has a plurality of small openings at a portion exposed to said expansion chamber, and in which said outlet pipe is formed at a given portion thereof with a plurality of openings exposed to said resonance chamber, said given portion being wrapped with a sound absorbing material, so that the given portion of the outlet pipe serves as a sound absorbing chamber.

14. A controllable muffler system according to claim 2, wherein one end of the first passage section is directly connected to the engine and another end of the first passage section is connected to the dual passage section.

15. A controllable muffler system for use with an engine that produces a power by burning fuel, comprising:

a first passage section extending from said engine for having an exhaust gas of the engine flow therethrough, said first passage section having a catalytic converter mounted thereon;

a dual passage section including second and third passage sections which extend separately from an end of said first passage section, said second passage having a control valve for controlling the flow rate of the exhaust gas flowing therethrough;

a fourth passage section extending from respective ends of said second and third passage sections to the open air, said fourth passage section having a rear muffler mounted thereon;

a control unit which controls said control valve of the second passage section in accordance with an operation condition of the engine; and a front muffler which is mounted on the passage section between said catalytic converter and an upstream end of said dual passage section.

16. A controllable muffler system for use with an engine that produces a power by burning fuel, comprising:

a first passage section extending from said engine for having an exhaust gas of the engine flow therethrough, said first passage section having a catalytic converter mounted thereon;

a dual passage section including second and third passage sections which extend separately from an end of said first passage section, said second passage having a control valve for controlling the flow rate of the exhaust gas flowing therethrough;

a fourth passage section extending from respective ends of said second and third passage sections to the open air, said fourth passage section having a rear muffler mounted thereon; and a control unit which controls said control valve of the second passage section in accordance with an operation condition of the engine, wherein at least one of said second and third passage sections has a center muffler mounted thereon, and wherein said rear muffler of said fourth passage section comprises:

a cylindrical shell having front and rear ends closed;

three partition panels arranged in said cylindrical shell to define first, second, third and fourth chambers in the same;

two inlet pipes each being inserted into the cylindrical shell and led to said third chamber, the two inlet pipes being connected to the ends of said second and third passages sections respectively;

two outlet pipes each extending through the cylindrical shell from said first chamber to the open air;

two inner pipes each extending between said first and third chambers through said second chamber; and a restricted opening formed in one of the partition panels to communicate a restricted communication between said third arid fourth chambers.

17. A controllable muffler system as claimed in claim 16, further comprising a plurality of small openings formed in given portions of the two inlet pipes, two outlet pipes and two inner pipes, said given portions being exposed to said second chamber thereby to cause said second chamber to serve as a resonance chamber.

18. A controllable muffler system as claimed in claim 17, in which said two outlet pipes have each a given portion wrapped with a sound absorbing material, so that the given portions of the outlet pipes serve as sound absorbing chambers.

19. A controllable muffler system for use with an internal combustion engine, comprising:

a first passage section extending from said engine for having an exhaust gas of the engine flow therethrough, said first passage section having a catalytic converter and a front muffler mounted thereon;

a dual passage section including second and third passage sections which extend separately from an end of said first passage section, said second passage having a control valve for controlling the flow rate of the exhaust gas flowing therethrough;

a fourth passage section extending from respective ends of said second and third passage sections to the open air, said fourth passage section having a rear muffler mounted thereon; and a control unit which controls said control valve of the second passage section in accordance with an operation condition of the engine.

20. A controllable muffler system as claimed in claim 19, wherein the dual passage section is arranged downstream of the first passage in a direction of flow of the exhaust gas.

21. A controllable muffler system according to claim 19, wherein one end of the first passage section is directly connected to the engine and another end of the first passage section is connected to the dual passage section.

* * * * *